US007299804B2

(12) United States Patent
Kittelsen et al.

(10) Patent No.: US 7,299,804 B2
(45) **Date of Patent: *Nov. 27, 2007**

(54) THREE PART COMPOSITE PERFORMANCE ENHANCING MOUTHGUARD

(76) Inventors: Jon D. Kittelsen, 1511 Innsbruck Dr. North, Fridley, MN (US) 55432; Henry D. Cross, III, 546 Old Field Rd., Mt. Gilead, Murrell's Inlet, SC (US) 29576; Paul C. Belvedere, 5824 Creek Valley Rd., Edina, MN (US) 55439-1212; Mark Herman, 1400 Lincoln, Minneapolis, MN (US) 55403

( * ) Notice: Subject to any disclaimer, the term of this patent is extended or adjusted under 35 U.S.C. 154(b) by 432 days.

This patent is subject to a terminal disclaimer.

(21) Appl. No.: 10/646,321

(22) Filed: Aug. 21, 2003

(65) Prior Publication Data

US 2004/0107970 A1 Jun. 10, 2004

Related U.S. Application Data

(63) Continuation-in-part of application No. 09/828,104, filed on Apr. 6, 2001, now Pat. No. 6,588,430, which is a continuation-in-part of application No. 09/828,108, filed on Apr. 6, 2001, now abandoned, which is a continuation-in-part of application No. 09/828,107, filed on Apr. 6, 2001, now Pat. No. 6,675,807, and a continuation-in-part of application No. 09/829,198, filed on Apr. 6, 2001, now Pat. No. 6,691,710.

(51) Int. Cl.
*A61C 5/14* (2006.01)

(52) U.S. Cl. ..... 128/859; 128/861; 128/862

(58) Field of Classification Search ..... 128/846, 128/848, 859–862; 602/902; 433/6
See application file for complete search history.

(56) References Cited

U.S. PATENT DOCUMENTS

| | | | | |
|---|---|---|---|---|
| 5,339,832 | A * | 8/1994 | Kittelsen et al. | 128/862 |
| 5,826,581 | A * | 10/1998 | Yoshida | 128/859 |
| 6,152,138 | A * | 11/2000 | Brown et al. | 128/859 |
| 6,237,601 | B1 * | 5/2001 | Kittelsen et al. | 128/859 |
| 2004/0250817 | A1 * | 12/2004 | Kittelsen et al. | 128/861 |

* cited by examiner

*Primary Examiner*—Michael A. Brown
(74) *Attorney, Agent, or Firm*—Gerald E. Helget; Briggs and Morgan, P.A.

(57) ABSTRACT

A performance enhancing and force absorbing mouthguard adapted to fit the upper teeth of the mouth of an athlete wherein the mouthguard is of a composite material. The first internal layer is a nonsoftenable flexible framework which will permit the mouthguard to hold its shape during fitting as well as to absorb and dissipate significant impact conveyed to the upper teeth. The framework includes hard, durable bite plate wedges which lower the condyle from the temporomandibular joint in a fulcrum action to place the lower jaw in an optimum condition preventing impingement upon the nerves and arteries as well as spacing the upper and lower teeth apart. Elastomeric traction pads are on the bottom of the mouthguard and are grippingly engaged by the posterior teeth of the lower jaw. The elastomeric pads extend forwardly to form an anterior impact brace on the front of the mouthguard. While the framework and traction pads are mechanically interlocked, a softenable material is placed over the mouthguard excepting the contact portions of the traction pads and anterior impact brace to encapsulate the mouthguard and to permit custom fitting.

17 Claims, 3 Drawing Sheets

THREE PART COMPOSITE PERFORMANCE ENHANCING MOUTHGUARD

This application is a continuation-in-part of application Ser. No. 09/828,104, filed Apr. 6, 2001 now U.S. Pat. No. 6,588,430, entitled COMPOSITE PERFORMANCE ENHANCING MOUTHGUARD WITH EMBEDDED WEDGE; application Ser. No. 09/828,108, filed Apr. 6, 2001 now abandoned, entitled COMPOSITE MOUTHGUARD WITH NONSOFTENING FRAMEWORK; application Ser. No. 09/828,107, filed Apr. 6, 2001 now U.S. Pat. No. 6,675,807, entitled QUADRUPLE COMPOSITE PERFORMANCE ENHANCING MOUTHGUARD; and application Ser. No. 09/829,198, filed Apr. 6, 2001 now U.S. Pat. No. 6,691,710, entitled COMPOSITE MOUTHGUARD.

BACKGROUND OF THE INVENTION

This invention generally relates to a performance enhancing and force absorbing composite mouthguard for use by athletes, and more particularly to such an adjustable customizable tethered mouthguard appliance that spaces apart the teeth to absorb shock and clenching stress to protect the anterior and posterior teeth of the upper jaw, to lessen condyle pressure, force and impact upon the cartlidge and temporomandibular joints, the arteries and the nerves and to further increase body muscular strength and endurance.

A number of mouthguards currently exist in the art for protecting the teeth and for reducing the chance of shock, concussions, and other injuries as a result of high impact collisions and blows during athletic competition. Mouthguards generally are characterized as being non-personalized, universal and stock model type, or are formed to have direct upper jaw tooth-formed contact. These are customizable mouthguards.

The lack of a mouthguard or the use of an improperly fitted mouthguard, when impacts, collisions or blows occur to the jaw structure of an athlete, have recently been found to be responsible for illnesses or injuries. Such injured athletes are susceptible to headaches, presence of earaches, ringing in the ears, clogged ears, vertigo, concussions and dizziness. The cause of these types of health problems and injuries are generally not visible by inspection of the mouth or the jaw but more particularly relate to the temporomandibular joint (TMJ) and surrounded tissues where the lower jaw is connected to the skull in the proximity where the auriculotemporalis nerves and supra-temporo arteries pass from the neck into the skull to the brain.

In addition to protection of the teeth and the TMJ, athletes clench their teeth during exertion which results in hundreds of pounds of compressed force exerted from the lower jaw onto the upper jaw. Such clenching can result in headaches, muscle spasms, damage to teeth, injury to the TMJ and pain in the jaw. Furthermore, clenching of the teeth makes breathing more difficult during physical exercise and endurance when breathing is most important.

Most importantly, many problems exist with prior mouthguards. Mouthguards with rigid labial or buccal walls do accept wide teeth, were bulky and had sharp edges. When the custom appliances were placed in hot water to soften for fitting, the mouthguards tended to collapse and permit portions to touch and stick together upon removal from the hot water thus making fitting of such mouthguards always a problem. Delamination and chewing destruction caused short life of the mouthguards.

There is a need for a mouthguard that solves all of the problems disclosed and will further achieve improved performance and long life as well as being easy to fit and wear for the athlete.

SUMMARY OF THE INVENTION

A performance enhancing and force absorbing mouthguard adapted to fit the upper teeth of the mouth of an athlete wherein the mouthguard is of a composite material. The first internal layer is a nonsoftenable flexible framework which will permit the mouthguard to hold its shape during fitting as well as to absorb and dissipate significant impact conveyed to the upper teeth. The framework includes hard, durable bite plate wedges which lower the condyle from the temporomandibular joint in a fulcrum action to place the lower jaw in an optimum condition preventing impingement upon the nerves and arteries as well as spacing the upper and lower teeth apart. Elastomeric traction pads are on the bottom of the mouthguard and are grippingly engaged by the posterior teeth of the lower jaw. The elastomeric pads extend forwardly to form an anterior impact brace on the front of the mouthguard. While the framework and traction pads are mechanically interlocked, a softenable material is placed over the mouthguard excepting the contact portions of the traction pads and anterior impact brace to encapsulate the mouthguard and to permit custom fitting.

The principle object and advantage of the present invention is that the mouthguard is that it protects the teeth, jaw, gums, connective tissues, back, head and muscles from concussive impact or blows to the jaw or teeth typically occurring during athletic activity.

Another object and advantage of the present invention is that the materials are substantially mechanically interlocked as well as encapsulated thereby preventing the possibility of delamination or separation of the materials which otherwise may occur during chewing of the mouthguard by the wearer.

Another object and advantage of the present invention is that the mouthguard places the lower jaw in the power position moving the condyle downwardly and forwardly away from the nerves and arteries within the fossia or socket to raise body muscular strength, greater endurance, improved performance by the mouthguard user as well as offer protection against concussive impacts.

Another object and advantage of the present invention is that the mouthguard is customizable to fit the width and configurations of the upper posterior teeth and palate structure of any user. That is, the mouthguard permits customizable fitting, including twisting, contraction and expansion, to permit the various tooth widths, spacing from one side of the mouth to the other side of the mouth, and palate height which also vary substantially from person to person.

Another object and advantage of the present invention is that it has a tough, rubbery elastomeric, unpenetrable bottom layer or traction pad which engages and grips the posterior teeth of the lower jaw and which further prevents the appliance from being chewed through to thereby assure long life to the appliance.

Another object and advantage of the present invention is that the framework of a non-softenable flexible material supports the appliance after heating to maintain shape and to guide the upper teeth during the fitting process.

Another object and advantage of the present invention is that the hard durable bite plate wedge of the framework is of a hard very durable material that acts as a bite plate wedge or fulcrum that cannot the be penetrated by teeth thereby giving the appliance a longer life cycle.

Another object and advantage of the present invention is that the labial and lingual walls are not rigid allowing the user to manipulate the softenable material and to custom fabricate the mouthguard to accommodate proper fitting and to achieve more comfortable and less intrusive presence in the wearers mouth.

Another object and advantage of the present invention is that an anti-microbial ingredient keeps the appliance free of germs, fungus, virus, yeast and bacteria and also may treat gum disease.

Another object and advantage of the present invention is an internal protective elastomeric bumper or anterior impact brace extending anteriorly from the traction pads for protecting the anterior teeth.

Another object and advantage of the present invention is that the mouthguard is suitable for bearing an artistic logo.

DETAILED DESCRIPTION OF THE PREFERRED EMBODIMENT

Figure 1:
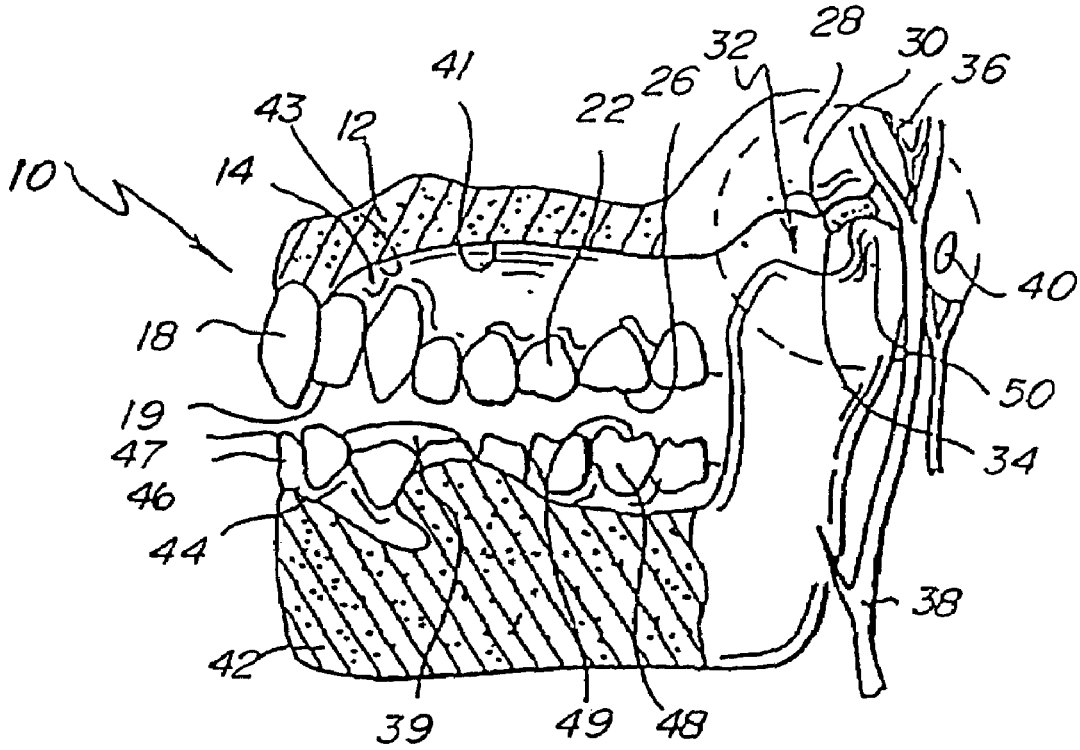
FIG. 1 is a maxillary mandibular buccal or partial side elevational view of the jaws and temporomandibular joint of the user of the mouthguard of the present invention.
Figure 1A:
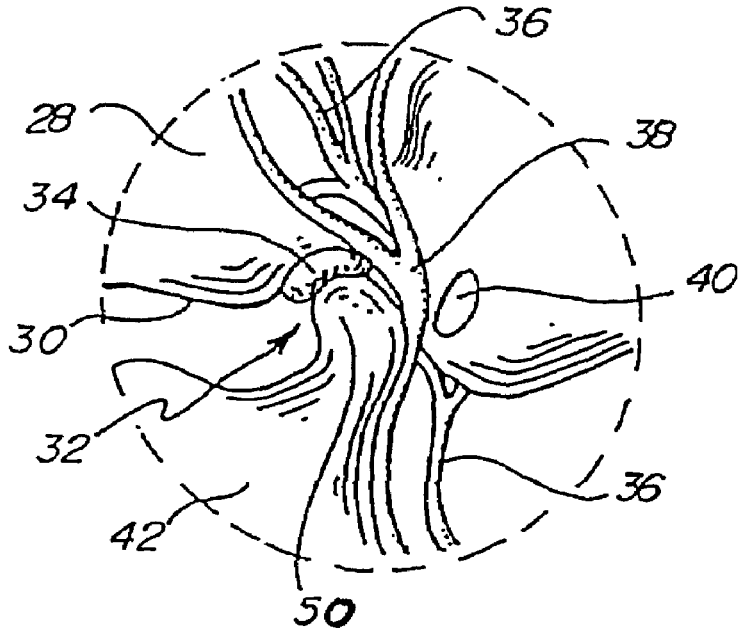
FIG. 1A is an enlarged view of the temporomandibular joint portion of FIG. 1.
Figure 2:
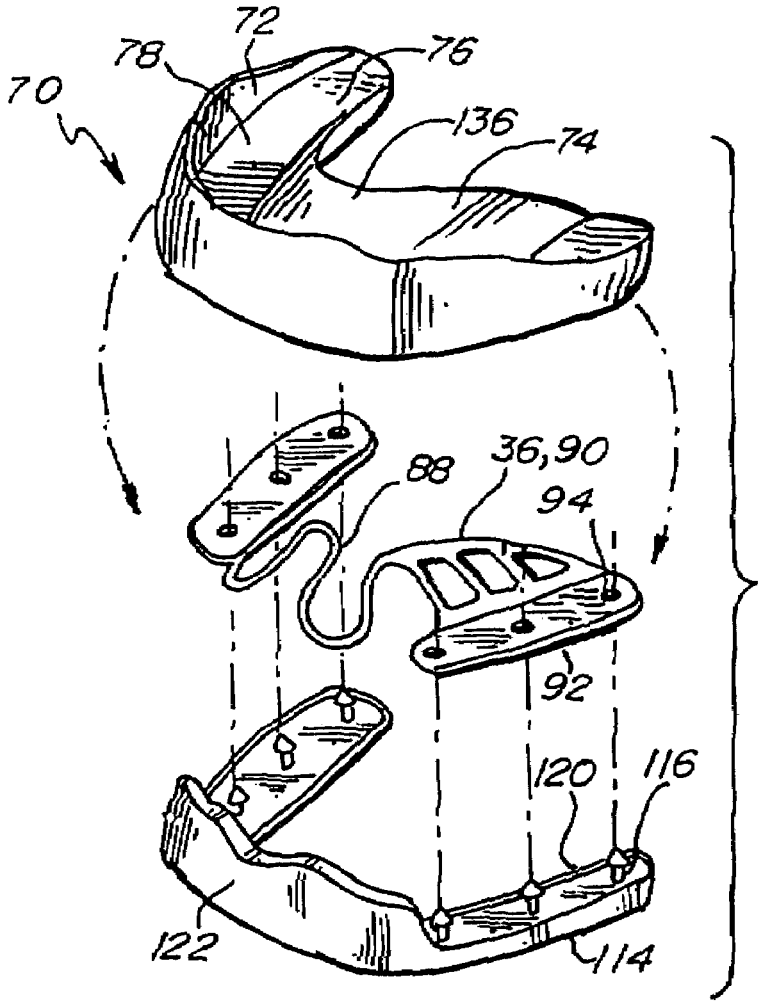
FIG. 2 is an exploded view of the composite mouthguard.

To understand the structural features and benefits of the dental appliance or mouthguard 70 of the present invention, some anatomy will first be described. Referring to FIGS. 1 and 1A, the user or athlete has a mouth 10 generally comprised of a rigid upper jaw 12 and a movable lower jaw 42 which are movably connected at the temporomandibular joint (TMJ) 32 and 50.

More specifically, the rigid upper jaw 12 has gum tissue 14 within mouth 10. Gum tissue 14, as well as the bone thereunder, supports anterior teeth (incisors and canines) 18 which have incisal or biting surfaces 19. The gum tissues 14 and the bone thereunder also support posterior teeth (molars and bicuspids) 22 which have cusps or biting surfaces 26.

Referring to one side of the human head, the temporal bone 28 is located upwardly and rearwardly of the upper jaw 12 and is in the range of $1/16^{th}$ to $1/32^{nd}$ inch thick. The articular eminence 30 forms the beginning of the fossae 32 or the socket of the temporomandibular joint 32 and 50.

Rearwardly and posteriorly to the articular eminence 30 is located cartilage 34. Through the temporomandibular joint 32 and 50 pass the ariculo-temporalis nerve 36 and supra-temporo artery 38. Posteriorly to this structure is located the inner ear 40. Within the mouth is located tongue 39 and the roof or hard palate 41, which terminates rearwardly into the soft palate and forwardly into the anterior palate or ruggae 43. The ruggae 43 has a rib surface which is identifiable by the fingers or tongue 39. The tongue touches the ruggae 43 during speech.

The movable jaw or mandible 42 supports a bone covered by gum tissue 44 which further supports anterior teeth (incisors and canines) 46 with incisal or biting surfaces 47 and posterior teeth (molars and bicuspids) 48 with occlusal biting surfaces 49. The condyle 50 of the lower jaw 42 forms the ball of the temporomandibular joint 32 and 50. The anatomical structure is the same for both sides of the head.

Repeated impacts, collisions, blows, stress or forces exerted on the movable lower jaw 42 results in excessive wearing forced upon the condyle 50 and the cartilage, meniscus, or disc 34—typically resulting in bone deterioration on the head of the condyle or slippage and compressive damage of the cartilage 34. Thereafter, the lower jaw 42 may be subject to irregular movement, pain, loss of comfortable range of movement, and clicking of the joint 32 and 50.

The ariculo-temporatis nerve 36 relates to both sensory and motor activity of the body. Any impingement or pinching of this nerve 36 can result in health problems as previously mentioned. This supra-temporal artery 38 is important in that it provides blood circulation to portions of the head. Impingement, pinching, rupture or blockage of this artery 38 will result in possible loss of consciousness and reduced physical ability and endurance due to the restriction of blood flow to portions of the brain. Thus, it is extremely important to assure that the condyle 50 does not impinge upon the ariculo-temporalis nerve 36 or the supra-temporal artery 38. It is also important to note that the temporal bone 28 is not too thick in the area of the glenoid fossae. Medical science has shown that a sharp shock, stress or concussive force applied to the lower jaw 42 possibly could result in the condyle 50 pertruding through the glenoid fossae of the temporal bone 28 thereby causing death. This is a suture line (growth and development seam) in the glenoid fossae, resulting in a possible weakness in the fossae in many humans. This incident rarely, but sometimes, occurs with respect to boxing athletes.

The mouthguard of the present invention is shown in the Figures as reference number 70.

Mouthguard 70 is generally u-shaped and is comprised of labial wall 72, lingual wall 74, which are upstanding from base 76, and channel 78 is formed by this arrangement.

Specifically referring to FIGS. 2-5, the mouthguard 70 generally comprises three layers of distinct materials 86, 114 and 136. The framework 86 is of a non-softenable, flexible material to assist in maintaining the shape of the heated mouthguard 70 and to permit the sizing of the mouthguard by way of twisting, expansion and contraction for variously configured mouths. The bite plate wedge 92 is part of the framework and permits displacement of the condyle and proper positioning of the lower jaw 42. The traction pads 114 are elastomeric and therefore rubbery and grippable. The anterior impact brace or internal protective bumper 122 extends from the traction pads 114. The encapsulating material 136 is softenable and forms walls 72 and 74 and channel 78. This portion of the mouthguard 70 softens when heated and permits custom fitting of the mouthguard 70 in a particular mouth configuration.

The first shot of the mouthguard 70 is comprised of the non-softenable, flexible framework 86 which is suitably made of high-density polyethylene which exhibits a rigid character in that it holds its shape and can handle hot water because its melting point is 270° Farenheit. The material also has excellent bonding qualities with other copolymers and is FDA compliant. The polyethylene part number appropriate for the framework 86 is HD-6706 from ExxonMobil Chemical Company, P.O. Box 3272, Houston, Tex. 77253-3272.

Figure 3:
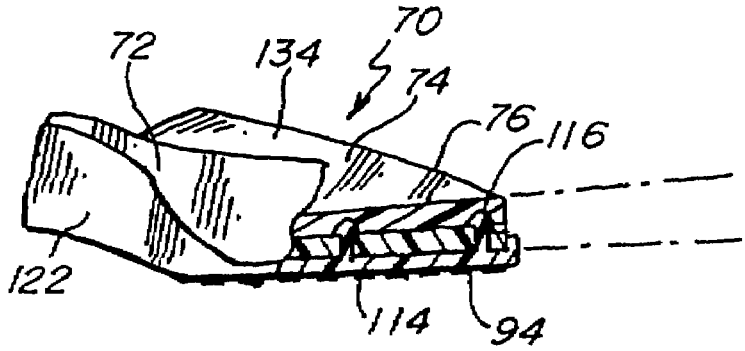
FIG. 3 is a side elevational view partially broken away of the mouthguard showing the wedge being thicker posteriorly than anteriorly.
Figure 4:
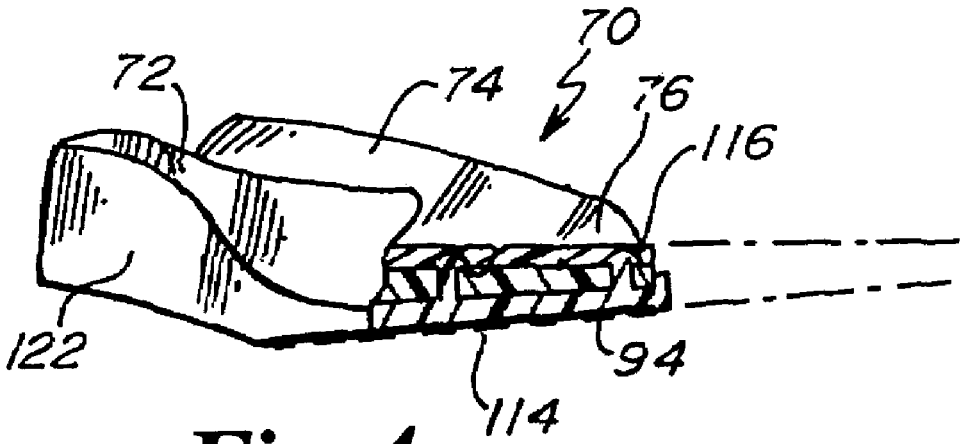
FIG. 4 is a side elevational view partially broken away similar to FIG. 3 with the wedge being thicker anteriorly than posteriorly.
Figure 5:
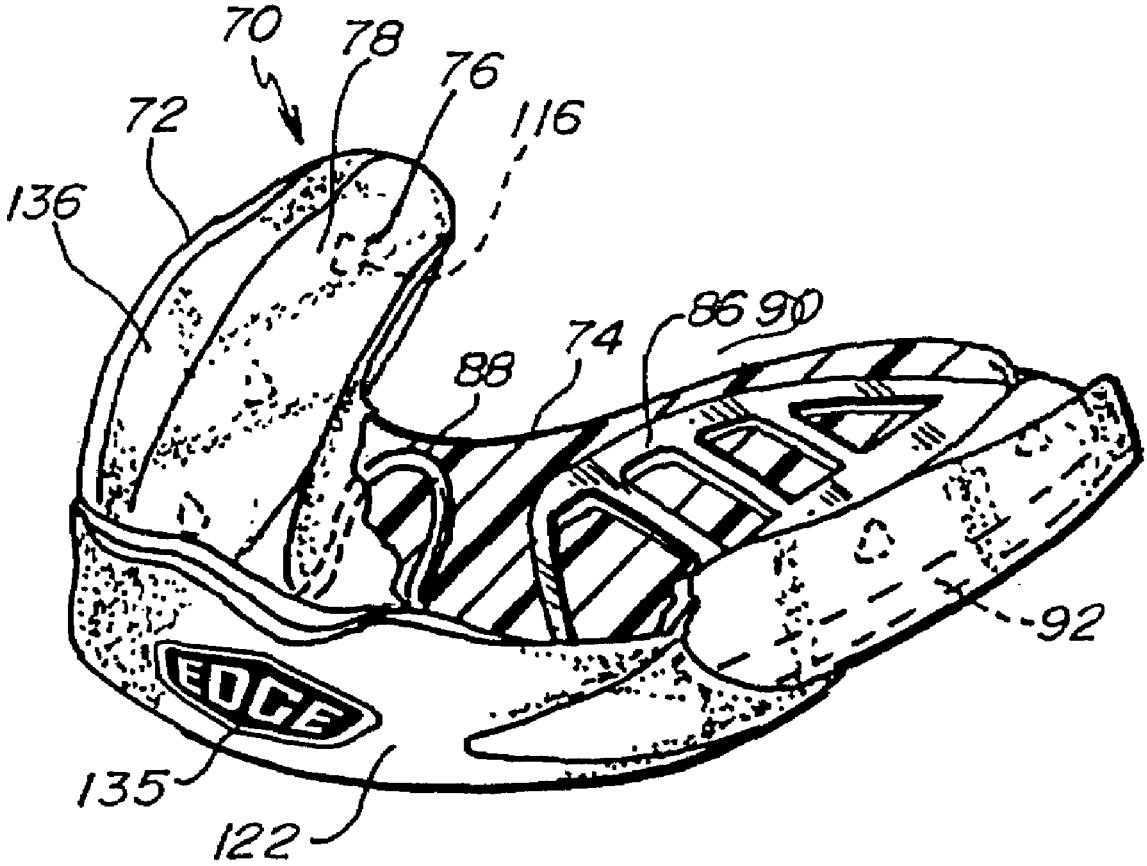
FIG. 5 is a perspective view of the mouthguard bearing a logo partially broken away.

The framework 86 suitably may have a connecting Belvedere bridge 88 which spans across the anterior portion of the labial wall 72. The bridge 88 then connects to Cross-cantilever connectors 90 which connect to the occlusal pad plates or wedges 92 in various places to assure the relative stability of the framework 86. The occlusal pad plates 92 shown in FIG. 3 are shown to be thicker posteriorly than anteriorly. The pad plates or wedges 93 in FIG. 4 are shown to be thicker anteriorly than posteriorly. The particular choice of plates or wedges 92 or 93 are dependent upon the physiology of the wearer of the mouthguard 70 suitably determined by medical assistance. The plates or wedges 92 have index openings 94 therethrough.

The next injection molding shot is that of traction pads 114 and anterior protective bumper or brace 122. The traction pads 114 contact and grip the occlusal biting surfaces 49 of the posterior teeth 48 of the lower jaw and must be composed of a durable, resilient material which deforms somewhat when the jaws are closed and cushion teeth 48 of the lower jaw 42.

The durable resilient material of this layer or second shot comprises a thermoplastic elastomer. The material may be Dynaflex®, Part No. G2780-0001 from GLS Corporation, 833 Ridgeview Drive, McHenry, Ill. 60050. This material is suitable in that the teeth can interdigitate on the pads 114 and the material is chemically and bondably compatible, as well as being FDA compliant and approved for mouthguards and has a melting point of approximately 400° Farenheit.

The traction pads 114 have projecting interlocking knobs or projections 116 which resemble a Christmas tree. The bucket lip or retaining lid 120 and interlocking knobs 116 assure that the pads 114 are interlocked with the bite plate wedges 92. Forward of the traction pads 114 extend an anterior impact brace or internal protective elastomeric bumper 122. Bumper 122 suitably supports an artistic logo 135 made of nylon.

The durable resilient material of the traction pads 114 and bumpers 122 and 126 may include in another embodiment a styrene block copolymer and ethylene vinyl acetate (EVA). EVA is available from a number of sources, such as ELVAX® Resins from Dupont Packaging and Industrial Polymers, 1007 Market Street, Wilmington, Del. 19398. It is desirable that the durable resilient material have a Shore "A" hardness of approximately 82, which is very durable, yet rubbery.

In another embodiment, the traction pads may have the styrene block copolymer mixed with polyolefin elastomer, which is a copolymer of ethylene and octene-1. A suitable copolymer is available under the trademark ENGAGE® from Dupont Canada, Inc., P.O. Box 2200, Streetsville, Mississauga, Ontario L5M 2H3.

Another embodiment of the pads and bumpers may be a mixture of thermoplastic rubber and a polyolefin elastomer as described above. Suitably thermoplastic rubbers are SANTOPRENE® from Advanced Elastomer Systems, L.P., 388 South Main Street, Akron, Ohio 44311 and KRATON® thermoplastic rubber from Shell Oil Company, Houston, Tex. KRATON® is composed of a styrene-ethylene-butylene-styrene block copolymer and other ingredients. The exact composition of SANTOPRENE® is a trade secret.

The third shot of the mouthguard 70 comprises an encapsulation material 136 which is suitably softenable and forms the walls 70 and 74 and channel 78, as well as base 76 of the mouthguard 70. Thus, the softenable material does not encapsulate the traction pads 114 or bumpers 122 and 126, but does encapsulate the entire framework 86.

The softenable outer fitting material 136 suitably comprises a mixture of EXACT®, which is a plastomer, Part No. 4023 from ExxonMobil Chemical Company, P.O. Box 3272, Houston, Tex. 77253-3272. The EXACT® (material is suitably blended 3:1 with a hydrocarbon resin called REGALREZ®, Part No. 1128 from Eastman Chemical Company, 200 South Wilcox, Kingsport, Tenn. 37660. These materials exhibit low melting points, good density and chemically and bondably compatible with other materials, as well as being FDA compliant for mouthguards.

Another combination of the softenable material 136 suitably comprises a mixture of EVA and polycaprolactone. A suitable polycaprolactone is TONE®, Part No. Polymer P-767 from Union Carbide Corporation, 39 Old Ridgebury Road, Danbury, Conn. 06817-0001. The softenable material may consist of polycaprolactone alone as the possibility of ethylene vinyl acetate alone may be utilized.

Another embodiment of the softenable outer material 136 may be a mixture of polycaprolactone and polyolefin elastomer. Preferably, the polyolefin elastomer is a copolymer of ethylene and octene-1. A suitable copolymer is available as ENGAGE® from Dupont Canada, Inc., P.O. Box 2200, Streetsville, Mississauga, Ontario L5M 2H3.

It is well known that illnesses, infection, tooth decay and/or periodontal disease is caused by bacteria, fungus, yeast and viruses. These microbials can grow and multiply on dental appliances when the appliances are being stored between uses, as well as when the appliance is being worn or used. An antimicrobial substance such as ANGION® from Angion Technologies LLC, 60 Autobon Road, Wakefield, Mass. 01880 may be blended with the framework 86, traction pads 114 and bumper 122, along with the softenable material 136. Other antimicrobial substances which are non-toxic and free of heavy metal for resisting the growth of microbials may include chlorinated phenol (e.g. 5-CHLORO-2-(2,-4-DICHLOROPHENOXY)PHENOL), POLYHEXAMETHYLENE BIGUANIDE HYDROCHLORIDE (PHMB), DOXYCYCLINE, HLORHEXIDINE, METRONIDAZOLE, THYMOL, EUCALYPOL and METHYL SALYCILATE. TRICLOSAN® from Siba Giegy of Switzerland is also available.

Mouthguard 70 incorporating the antimicrobial agent during the manufacture of the mouthguard is achieved by incorporating the agent into the synthetic polymer master batch. The antimicrobial agent is suitably placed into the batch in a concentration as high as 10% which will permit a let-down ratio resulting in final concentration of the antimicrobial agent and the dental appliance of about 0.005 to about 2% by weight. The antimicrobial agent will survive molten temperatures of approximately 350° Farenheit and thus the antimicrobial agent loses none of its biocidal properties in the formation of the mouthguard.

To fit the mouthguard 70 to the user's mouth, the mouthguard is placed in hot water at 211° Farenheit (i.e. water that has been brought to a boil and taken off the heat) for about fifteen seconds. The mouthguard is then removed from hot water, and it will be very soft, but the framework 86 will hold the mouthguard in its general shape. Excess water is allowed to drain off the mouthguard 70 by holding it with a spoon or a fitting tool.

Next, the wearer carefully places the mouthguard in the mouth so that the interior portion of the appliance 70 touches and covers the eye teeth and extends backwards towards the molars. Next, the wearer bites down firmly on the appliance and pushes the tongue against the roof of the mouth. The Cross-cantilever connectors guide the upper molars 22 in position on plates 92. With a strong sucking motion, the wearer draws out all of the air and water from the mouthguard 70. The projections or knobs 116 of the traction pads 114 will index to the cusps 26 of the molars 22.

With the thumb, the wearer presses the bridge 88 and lingual wall 74 tight against the mouth and then uses his hands and fingers to press the outside of the cheeks against the appliance as the labial wall 72 moves to custom form the lingual and buccal or labial walls 72 and 74, respectively. Because there are no rigid lingual or labial walls in the appliance 70, the mouthguard 70 will fit any width of molar 22 or mouth.

The wearer retains the mouthguard in the mouth for at least one minute and, with the mouthguard still in the mouth, takes a drink of cold water. Next, the wearer removes the mouthguard from the mouth and places it in cold water for about thirty seconds.

The present invention may be embodied in other specific forms without departing from the spirit or central attributes thereof, therefore, the illustrated embodiments should be considered in all respects as illustrative and not restrictive, reference being made to the appended claims rather than to the foregoing description to indicate the scope of the invention.

The invention claimed is:

1. A three-part composite performance enhancing mouthguard having a u-shaped base with upstanding labial and lingual walls forming a channel, comprising:

(a) a non-softenable, flexible framework of posterior occlusal bite wedges in the base connected by an expansible contractible bridge in the lingual wall;

(b) two elastomeric traction pads below the wedges and are anteriorly connected by an anterior impact bumper; and (c) a layer of heat softenable fitting material encapsulating the framework and forming the labial and lingual walls.

2. The three-part composite performance enhancing mouthguard of claim 1, wherein the pads are mechanically interlocked to the wedges.

3. The three-part composite performance enhancing mouthguard of claim 1, wherein the pads and bumper are not encapsulated by the fitting material.

4. The three-part composite performance enhancing mouthguard of claim 1, wherein the framework, the traction pads and the anterior impact bumper will not melt in boiling water.

5. The three-part composite performance enhancing mouthguard of claim 1, wherein the fitting material will soften and melt in boiling water.

6. The three-part composite performance enhancing mouthguard of claim 1, further comprising Cross-cantilever connectors between the wedges and the bridge.

7. The three-part composite performance enhancing mouthguard of claim 1, wherein the wedges are thicker posteriorly rather than anteriorly.

8. The three-part composite performance enhancing mouthguard of claim 1, wherein the wedges are thicker anteriorly rather than posteriorly.

9. A three-part composite performance enhancing mouthguard having a u-shaped base with upstanding labial and lingual walls forming a channel, comprising:

(a) a non-softenable, flexible framework of posterior occlusal bite wedges in the base connected to an expansible contractible bridge by Cross-cantilever connectors in the lingual wall;

(b) two elastomeric traction pads below the wedges and are anteriorly connected by an anterior impact bumper; and (c) a layer of heat softenable fitting material encapsulating the framework and forming the labial and lingual walls.

10. The three-part composite performance enhancing mouthguard of claim 9, wherein the pads are mechanically interlocked to the wedges.

11. The three-part composite performance enhancing mouthguard of claim 9, wherein the pads and bumper are not encapsulated by the fitting material.

12. The three-part composite performance enhancing mouthguard of claim 9, wherein the framework, the traction pads and the anterior impact bumper will not melt in boiling water.

13. The three-part composite performance enhancing mouthguard of claim 9, wherein the fitting material will soften and melt in boiling water.

14. The three-part composite performance enhancing mouthguard of claim 9, further comprising Cross-cantilever connectors between the wedges and the bridge.

15. The three-part composite performance enhancing mouthguard of claim 9, wherein the wedges are thicker posteriorly rather than anteriorly.

16. The three-part composite performance enhancing mouthguard of claim 9, wherein the wedges are thicker anteriorly rather than posteriorly.

17. A three-part composite performance enhancing mouthguard having a u-shaped base with upstanding labial and lingual walls forming a channel, comprising:

(a) a non-softenable, flexible framework of posterior occlusal bite wedges in the base connected to an expansible contractible bridge by Cross-cantilever connectors in the lingual wall;

(b) two elastomeric traction pads mechanically interlocked to and below the wedges and are anteriorly connected by an anterior impact bumper; and (c) a layer of heat softenable fitting material encapsulating the framework and forming the labial and lingual walls.

* * * * *